US008419667B2

(12) United States Patent
Chika

(10) Patent No.: US 8,419,667 B2
(45) Date of Patent: Apr. 16, 2013

(54) ELECTRIC SHOWER MASSEUSE

(76) Inventor: Hani Elias Chika, San Diego, CA (US)

( * ) Notice: Subject to any disclaimer, the term of this patent is extended or adjusted under 35 U.S.C. 154(b) by 1160 days.

(21) Appl. No.: 12/081,965

(22) Filed: Apr. 24, 2008

(65) Prior Publication Data

US 2008/0287845 A1 Nov. 20, 2008

Related U.S. Application Data

(60) Provisional application No. 60/924,485, filed on May 17, 2007.

(51) Int. Cl.
*A61H 9/00* (2006.01)

(52) U.S. Cl.
USPC ..... 601/158

(58) Field of Classification Search ..... 601/136, 601/155, 157, 158; 4/606
See application file for complete search history.

(56) References Cited

U.S. PATENT DOCUMENTS

| | | | | | |
|---|---|---|---|---|---|
| 4,008,503 | A * | 2/1977 | Tharp | ..... | 15/88.3 |
| 4,040,132 | A * | 8/1977 | Braun | ..... | 4/606 |
| 4,274,400 | A | 6/1981 | Baus | | |
| 4,704,756 | A * | 11/1987 | Williams et al. | ..... | 15/21.1 |
| 5,033,897 | A | 7/1991 | Chen | | |
| 5,239,712 | A * | 8/1993 | Kinder | ..... | 4/606 |
| 5,561,869 | A * | 10/1996 | Sarel | ..... | 4/606 |
| 5,774,907 | A * | 7/1998 | Doggwiler | ..... | 4/606 |
| 6,732,394 | B1 | 5/2004 | Waterman | | |
| 6,775,864 | B2 | 8/2004 | Cannetti | | |
| 6,996,861 | B1 * | 2/2006 | Clark, Jr. | ..... | 4/606 |
| 7,120,947 | B1 | 10/2006 | Magallanes | | |
| 7,308,724 | B2 | 12/2007 | Ho | | |
| 7,451,513 | B2 * | 11/2008 | Torres | ..... | 15/21.1 |
| 2003/0167565 | A1 | 9/2003 | Yoshida | | |
| 2004/0060107 | A1 * | 4/2004 | Eisenberg | ..... | 4/605 |

* cited by examiner

*Primary Examiner* — Michael A. Brown

(57) ABSTRACT

The present invention is suspended between the shower sliding door frame and the opposite shower wall. It has two large rotating disk wheels that massage and clean the body. A water reservoir allows soapy water to flow gently onto both shower disk wheels continuously, enabling the user to limit the volume of water used. The disk wheels spin in opposite directions at the same speed, controlled by a single motor and a drive belt that rotates two shafts. The lower disk wheel moves forward and backward to conform to the contours of the body. The unit is braced against the back wall of the shower enclosure and kept in position by adjustable arms. It can be raised and lowered to clean the upper and lower body. Its speed and efficiency lead to conserving water, time, and energy. The invention is especially useful for anyone with limited hand or arm mobility.

7 Claims, 5 Drawing Sheets

ELECTRIC SHOWER MASSEUSE

The Electric Shower Masseuse (FIG. 1) is suspended between the top of the sliding door frame of an existing shower enclosure and the opposite side shower wall. It has two large rotating disk wheels that gently massage and clean the human body automatically, both attached to the same body unit. A container of soapy water directs the soapy water to flow onto the two disk wheels continuously through the shower. The disk wheels spin in opposite directions at exactly the same speed, controlled by a single motor and a round rubber belt that connects two shafts. The lower disk wheel also moves backwards and forwards to maintain continuous contact with the contours of the user's body. It is braced against the back wall of the shower enclosure and kept in position by adjustable arms. The unit is intended to be repositioned to clean the human body from shoulders to feet. This is accomplished by raising and lowering the unit through a set of pulleys and a pulley cord. Its speed and efficiency make it ideal for conserving time, water, and energy. In addition to massaging the body, it cleans thoroughly and is especially useful for anyone with limited hand or arm mobility.

The horizontal bar that hangs the Electric Shower Masseuse can be adjusted to fit any width shower enclosure. A rail is mounted on the inside wall of the shower. One end of the horizontal bar slides inside the rail to position the unit at the appropriate place within the length of the shower. The other end of the horizontal bar fits over the shower door enclosure and is tightened in place. A spring pushes the horizontal bar toward the wall so that the unit is firmly positioned in place.

The Electric Shower Masseuse is braced against the back wall of the shower by two support arms that adjust to any distance necessary.

Facing the disk wheels, the upper disk wheel rotates counter-clockwise and the lower disk wheel rotates clockwise (although they can be reversed). Two disk wheels spinning in opposite directions at the same speed stabilize and balance the unit so that it stays in the center location. By changing the motor, the disk wheels can be set up to rotate faster or slower. The disk wheels can also be set to vibrate or make half-turns back and forth. It is also possible to configure the unit for ultrasonic cleaning. While it is spinning, the lower disk wheel can be pushed backward and forward to fit the contours of the body. The fronts of the disk wheels are made of soft fabric impression rubber. Beneath the rubber is flexible padding to give the disk wheels a convex shape. The disk wheels can be covered with removable fabric. When the unit is on, a soapy water reservoir dispenses soapy water to coat the rubber disk wheels.

To operate the device, the user positions the Electric Shower Masseuse by pulling the pulley rope vertically as needed so that the upper disk is at shoulder level. The user fills the water reservoir with water and liquid soap. The user then lowers the water dispensing tube to the horizontal position so that the rubber end of the tube can reach the body. This will allow the soapy water to flow onto the shower disk wheels and onto the body. Because clean water is continuously flowing, the user can limit the volume of water coming from the showerhead until it is time to rinse.

The user turns on the Electric Shower Masseuse and leans toward the disk wheels. To begin, the user leans one arm into the disk wheel, and then rotates the arm to clean both the outside and the inside of the arm. The user then turns slowly, keeping the front of the body in constant touch with both disk wheels, allowing them to clean and massage the body. When the other arm is in contact with the shower disk wheel, the user follows the same process as the first. As the Electric Shower Masseuse massages the back, hands will be free for additional cleaning. The lower disk wheel can be pushed in and out, enabling it to stay in contact with the contours of the body.

After two full turns, the user can release the pulley rope and lower the unit so that the lower disk wheel is at knee level. The user washes the lower half of the body with another one or two full turns, and the body is fully clean.

The Electric Shower Masseuse is operated by rechargeable batteries or by electricity using an AC transformer mounted outside the shower enclosure.

CROSS-REFERENCE TO RELATED APPLICATIONS

Not applicable.

BACKGROUND OF THE INVENTION

In October 2004, I was taking a shower as usual but I had a pain in my right elbow. Taking a shower was very difficult. I started looking for some electrical means on the market to help me shower thoroughly and comfortably; I could not find anything that worked. As an inventor, I knew I could do something about it. There are many electric tools such as the electric toothbrush, car wash, electrical massager, etc. Why not an electric shower masseuse? It cleans, massages, and scrubs the body gently just by the click of a switch. I made sketches and a prototype, and gave them to a machinist to refine the components. I continued to improve the design, testing it and looking for the right materials. I made more sketches and drawings and gave them to the machinist. Then I tested the product and made changes on the drawings as needed. Finally, I was satisfied with the product.

The present invention is related to Classification 4 (Baths, Closets, Sinks, and Spittoons). This refers to subject matter having means for spraying water on the body of a user, and sub-class 605 (Convenience Accessories), which is subject matter wherein there is provided additional means for aiding or adding to the comfort of the user, or to perfect the shower.

It is also related to Classification 601 (Surgery: Kinesitherapy). This refers to subject matter designed to act upon the body by moving, vibrating, or massaging a portion of the body to produce a therapeutic effect and in which the movement of the patient is passive, and sub-class 136 (Frictioning), wherein the body-contacting means rubs the body or acts upon the body by surface resistance to relative motion.

The present invention is directed to a unit that is suspended in the shower enclosure. This device cleans and massages the body while saving time, energy, and water. The device enables the user to clean not just the hard-to-reach areas, but the entire body, effectively and efficiently.

The device also has applications for people with limited arm or hand mobility. Although there are devices like electric toothbrushes and electric massagers, there is still a need for an electrical means to help shower thoroughly and comfortably, as well as for a device that enables the users to save time, energy, and water.

Known prior art includes U.S. Patent 2003/0167565; U.S. Patent Application Number 2004/0060107; U.S. Pat. No. 4,008,503; U.S. Pat. No. 4,040,132; U.S. Pat. No. 4,704,756; U.S. Pat. No. 5,239,712; U.S. Pat. No. 5,561,869; U.S. Pat. No. 5,774,907; U.S. Pat. No. 6,996,861; and U.S. Pat. No. 7,451,513. None of the above-cited patents perform the same functions using the same mechanisms outlined in the patent application for the Electric Shower Masseuse.

U.S. Patent Application Number 2003/0167565 describes a motorized body scrubber that is (1) permanently mounted inside the shower enclosure and (2) uses one rotating sponge scrubber and (3) requires a connection to a water supply line. Our present invention describes a device that (1) is not permanently mounted in the shower enclosure, enabling it to be moved closer or farther from the shower head; (2) uses two rubber disk wheels that rotate in opposite directions to stabilize the motion to clean and massage the body of the user using one single battery-powered gear motor; and (3) has its own separate water and soap dispensing container, without the need to connect to the water supply line.

U.S. Patent Application Number 2004/0060107 describes an individually adjustable, automated, whole-body washing apparatus that consists of (1) running water and tactile stimulus-like members that respond to signals from a controller; and (2) does require a permanent installation in the shower enclosure. Our present invention (1) relies on a gravity-fed water source that does not need to be connected to water supply lines; and (2) two rubber disk wheels that rotate in opposite directions to clean and massage the body of the user using one single battery-powered gear motor.

U.S. Pat. No. 4,008,503 describes (1) a rotary shower brush that is mounted permanently in the shower enclosure, and (2) uses one tubular brush that rotates in only one direction, and (3) relies on a connection to water supply lines. Our present invention (1) does not require permanent installation, and (2) uses two rubber disk wheels that rotate in opposite directions to clean and massage the body of the user using one single battery-powered gear motor, and (3) uses a separate gravity-fed water enclosure that does not require a connection to water supply lines.

U.S. Pat. No. 4,040,132 describes a backscrubber that (1) is permanently mounted inside the shower enclosure, (2) uses cylindrical scrubbers that are best suited to cleaning the user's back only. Our present invention (1) is a device that is not permanently mounted in the shower, and (2) has two rubber disk wheels that rotate in opposite directions to clean and massage the entire body of the user using one single battery-powered gear motor.

U.S. Pat. No. 4,704,756 describes a water-powered back scrubber that (1) is permanently mounted in the shower enclosure, and (2) that is exclusively to clean the back of the user, and (3) that is operated by a water pump operated by water diverted from the water supply lines. Our present invention (1) is not permanently mounted in the shower enclosure and (2) can be used to clean the entire body of the user, and (3) is not dependent on a connection to water supply lines and is operated by one single battery-powered gear motor.

U.S. Pat. No. 5,239,712 describes a shower unit for individuals with hand dysfunction, which consists of (1) one rotating disk pad and one oscillating brush and (2) relies on a connection to the water supply lines, and (3) is permanently mounted at a fixed height in the shower enclosure. Our present invention (1) uses two rubber disk wheels that rotate in opposite directions using one single battery-powered gear motor to clean and massage the entire body of the user, and (2) is independent of water supply lines because of its separate gravity-fed water container, and (3) can be raised and lowered to clean and massage the entire body of the user.

U.S. Pat. No. 5,561,869 describes a shower-mounted body washer consisting of (1) multiple rotary brushes that (2) uses water diverted from the water supply lines to drive impellers that rotate the brushes, and (3) uses spray nozzles to inject soap. Our present invention (1) cleans and massages with two rubber disk wheels that rotate in opposite directions using one single battery-powered gear motor, and (2) uses a gravity-fed water container that is not dependent on a connection to water supply lines, and (3) does not use spray nozzles to inject soap.

U.S. Pat. No. 5,774,907 describes a non-motorized shower wall back scrubber and massager that (1) is not motorized so is dependent on water pressure, (2) consists of a non-rotating brush, and (3) is connected to water supply lines. Our present invention (1) uses one single battery-powered gear motor, and (2) cleans and massages the entire body with two rubber disk wheels that rotate in opposite directions, and (3) has its own separate gravity-fed water container so that it is not dependent on a connection to water supply lines.

U.S. Pat. No. 6,996,861 describes a shower-mounted back cleansing and massaging apparatus that (1) hangs from the shower head, and (2) uses a series of rotating brushes controlled by a variable speed motor, and (3) can only be used on a limited section of the body. Our present invention (1) is suspended between the top of the door of the shower enclosure and the opposite wall, and (2) describes two rubber disk wheels that rotate in opposite directions to clean and massage the entire body of the user using one single battery-powered gear motor, and (3) can be adjusted to reach all areas of the body, including sensitive parts.

U.S. Pat. No. 7,451,513 describes a back-scrubbing and cleansing apparatus that (1) relies on bristles rotating in the same direction, and (2) cannot be adjusted during use. Our present invention (1) uses two rubber disk wheels that rotate in opposite directions controlled by one single battery-driven gear motor, and (2) can be raised and lowered during use to reach all parts of the body.

None of the above-cited patents perform the same functions using the same mechanisms outlined in the patent application for the Electric Shower Masseuse.

This device differs from prior art in several key dimensions:

1. It is suspended freely from the frame of the shower, as opposed to being handheld or attached to the wall or shower head. The suspension system is designed to position the unit at the desired location in the shower quickly and easily and the unit is held there securely. This is accomplished by installing a rail on the wall of the shower opposite the door frame. One end of the hanging bar slides inside the wall rail. The other end of the hanging bar fits over the shower door frame and is held there with a system of door support blocks that are tightened by knobs and screws. A powerful hidden spring pushes the first end of the hanging bar toward the wall to ensure its stability.

2. The disk wheels are designed to rotate in opposite directions at exactly the same speed. This is accomplished by using one motor to propel two pulleys that are connected by means of a round belt. The belt is configured in the shape of a figure eight, thereby rotating the two shafts in opposite directions. Because the two disk wheel spin at exactly the same speed in opposite directions (clockwise and counter-clockwise), the unit is stabilized while the disk wheels are in motion. The disk wheels can be configured to move faster or slower by changing the motor. The size and speed of the disk wheels are important in order to maximize time efficiency and thereby maximize water conservation. A typical shower can be shortened to about two minutes, still allowing the user to be fully clean.

3. The lower disk wheel can be moved backward and forward while it is spinning to conform to the contours of the body. This is accomplished with a system of sliding tubes; two rods move freely inside four tubes. As the user leans on the lower disk wheel, the tubes slide inside each other and the disk wheel moves backward. When the user releases the pressure, springs return the disk wheel to the original position automatically. This allows the cleaning and massaging disk wheel to conform to the contours of the user's body. The belt and pulley system is the key to making this process work. The first important point is that the stretchable belt is round, rather than flat. This is necessary so that as the lower pulley is moved backward and forward by the pressure on the disk wheel, the belt can roll around itself and not be forced off the pulley. The pulleys have a special design that includes a deeper-than-typical side wall and a flat (not rounded) belt surface that is imbedded with inverted V-shaped notches that grip the belt and keep it from slipping.

4. Because the belt is in the shape of a figure eight, the two parts of the belt need to be separated where they cross each other. A separator guide was invented, consisting of a metal nail, surrounded by a metal tube. A metal pin runs through a hole in the sharp end of the nail and attaches it to the center of a hollow rubber pad that is secured to the body of the unit. This design allows the nail inside the tube to move almost 70 degrees in any direction as the belt turns.

5. The unit can be raised and lowered in a single motion to clean both the upper and lower body. While the preferred embodiment shows a system of pulleys and ropes, the unit can also be motorized to perform this function.

6. The arms that support the back of the unit and hold it firmly away from the wall also have unique design features. A single control knob allows the user to control the distance from the wall. Loosening the knob allows a spring to pull the arms together. Pushing the body against the disk wheels forces the arms apart; at the desired distance, the control knob is tightened to hold the arms in the desired position. The user is able to set a variety of distances because of the design of the T-shaped back support rail. The rail includes an open channel the length of the rail through which the control knob and its screw pass. The screw can be fastened at any point on the channel because of the design of the securing mechanism. This mechanism consists of a square ring with a flat square inside at the bottom. The square ring is placed around the long portion of the T-shaped rail. The screw of the knob passes through the top of the square ring, through the open channel, and through the flat square, then through the bottom of the square ring. When the control knob is tightened, the flat square is drawn up toward the plastic channel of the T-shaped rail. Small teeth on the flat square grip the plastic tightly and hold the square ring at the desired position.

BRIEF SUMMARY OF THE INVENTION

The intention of the present invention is to demonstrate the following benefits:

1. Clean the body very quickly and much more thoroughly, especially hard-to-reach areas on the back, sides or lower body.
2. Massage the body and rejuvenate the skin, while being very gentle to all sensitive parts of the body.
3. Save time and money.
4. Conserve energy by using less hot water.
5. Conserve water in the shower (as much as 70%, as documented by the inventors personal water bills), especially important in areas with water shortages.
6. Preserve the environment by conserving on hot water and natural gas.
7. Enjoy the pleasant feeling of a gentle and warm body massage, without relying on water pressure.
8. Clean the body thoroughly even for people with limited mobility.
9. Self-cleaning; since the device does not depend on a brush, the surface that touches the body is continually bathed in clean soapy water, and residue cannot accumulate.
10. Rechargeable batteries, good for about 60 minutes or more of use between charges, depending on the motor requirement and the number of batteries used.

This device solves many of the problems of previous inventions, as follows:

Because other inventions (such as U.S. Patent Application Number 2003/0167565; U.S. Patent Application Number 2004/0060107; U.S. Pat. No. 4,008,503; U.S. Pat. No. 4,704,756; U.S. Pat. No. 5,239,712; U.S. Pat. No. 5,561,869; and U.S. Pat. No. 5,774,907) rely on water flow from the shower to provide the massage function, they cannot also conserve water.

Because other inventions (such as U.S. Patent Application Number 2003/0167565; U.S. Pat. No. 4,008,503; U.S. Pat. No. 4,040,132; U.S. Pat. No. 4,704,75; U.S. Pat. No. 5,239,712; U.S. Pat. No. 5,561,869; U.S. Pat. No. 5,774,907; U.S. Pat. No. 6,996,861; and U.S. Pat. No. 7,451,513) that are mounted in the shower are completely fixed, the portions that touch the body cannot be moved forward and backward at will. The present invention allows adjustment to conform to the contours of the user's body.

BRIEF DESCRIPTION OF THE SEVERAL VIEWS OF THE DRAWING

The drawings of one of the preferred embodiments of the invention are included, as follows:

Sheet 1/5, FIG. 1, view of the front side

Figure 2A:
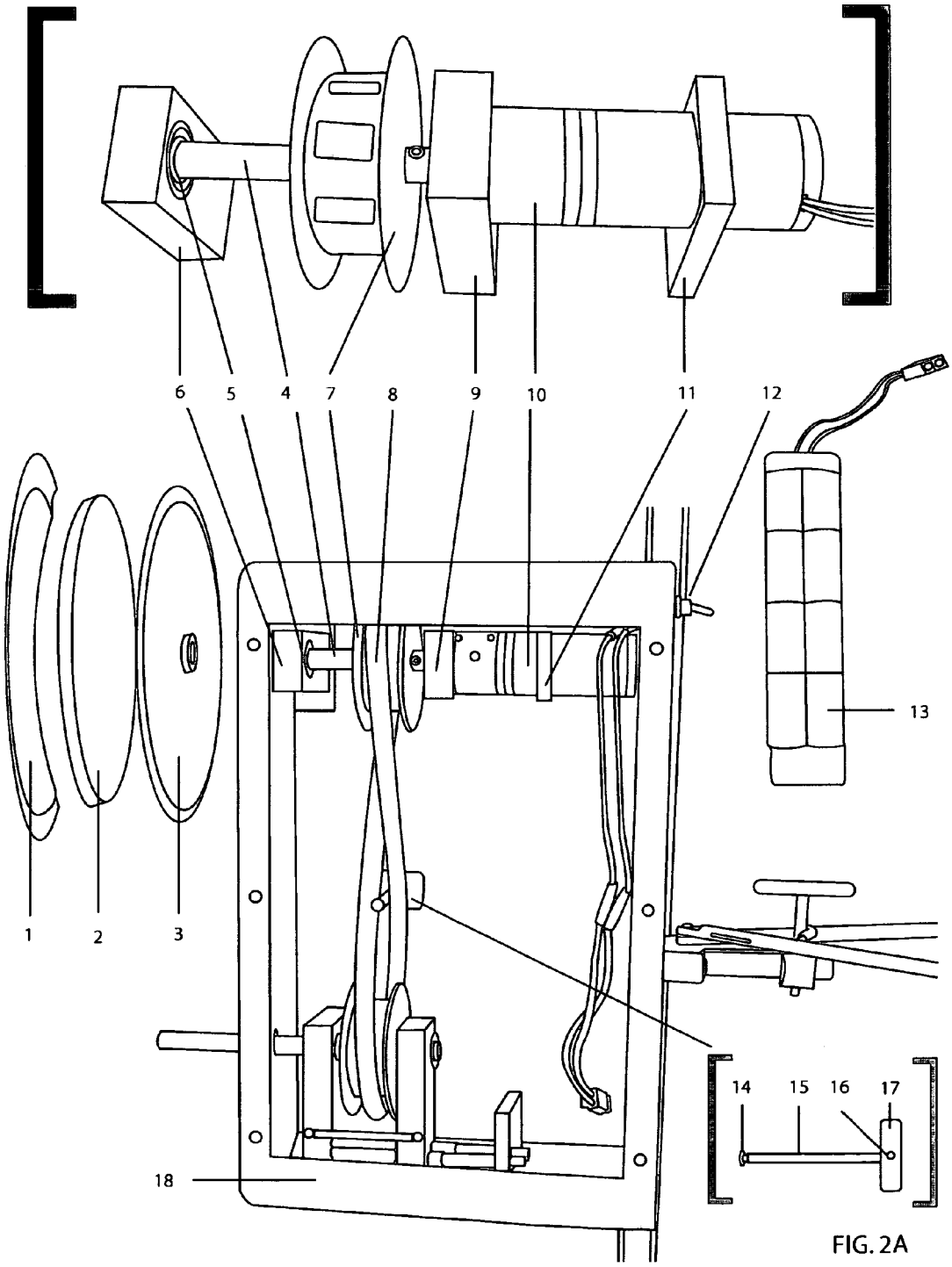

Sheet 2/5, FIG. 2A, detail view of the interior, upper shaft assembly

Figure 2B:
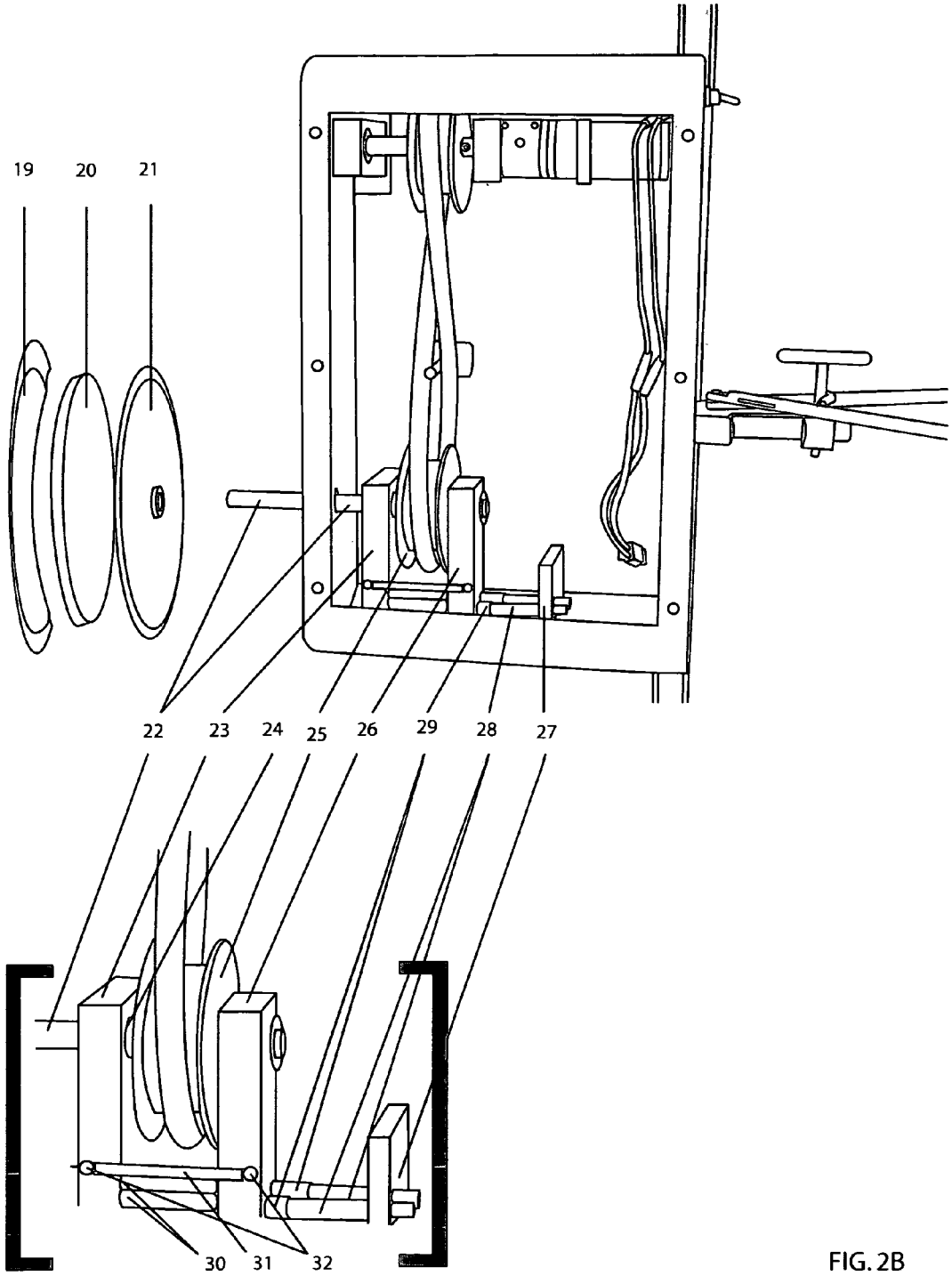

Sheet 3/5, FIG. 2B, detail view of the interior, lower shaft assembly

Figure 3A:
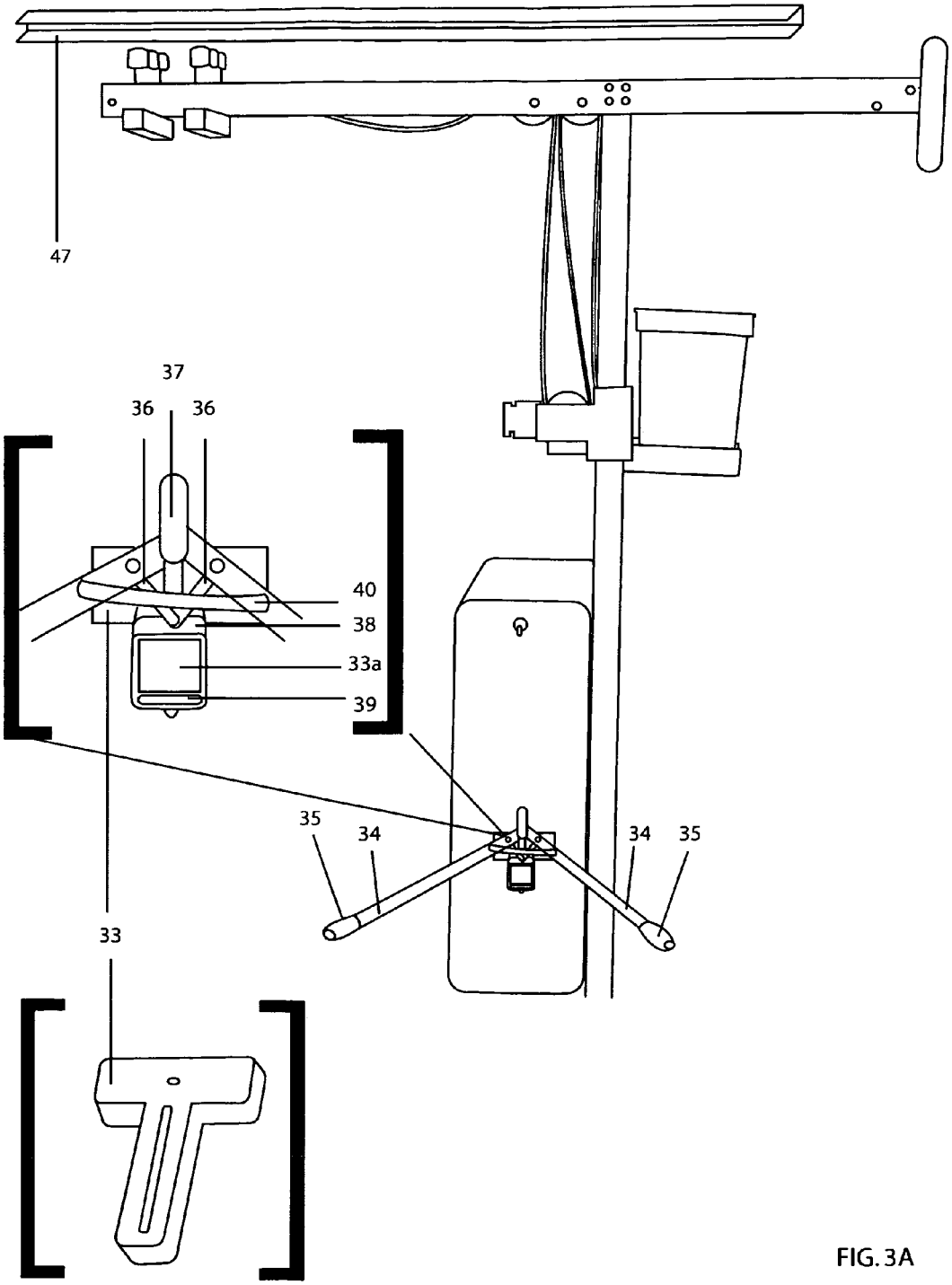

Sheet 4/5, FIG. 3A, detail view of the lower portion of the back side

Figure 3B:
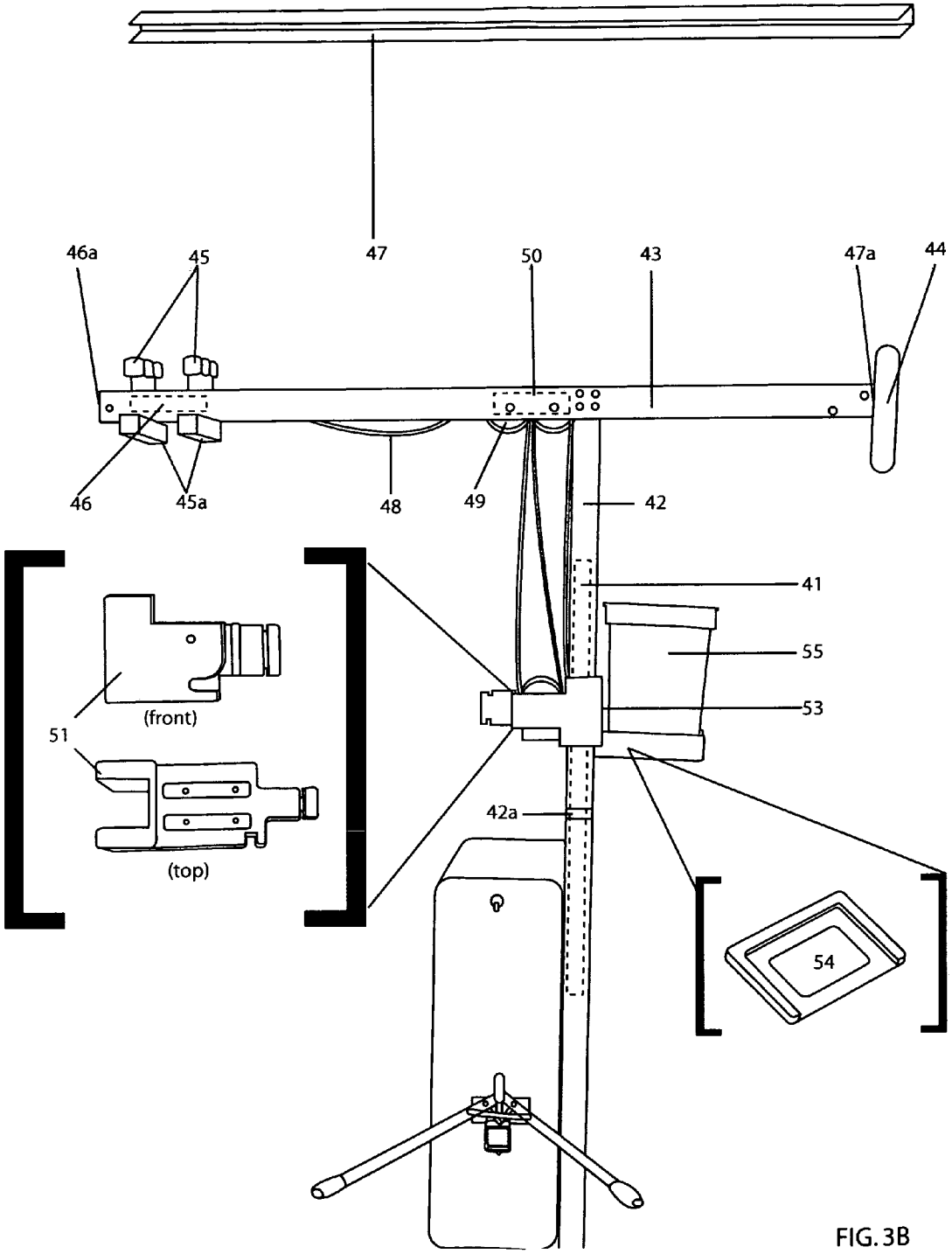

Sheet 5/5, FIG. 3B, detail view of the upper portion of the back side

DETAILED DESCRIPTION OF THE INVENTION

The Electric Shower Masseuse (FIG. 1) is suspended between the top of the sliding door frame of an existing shower enclosure and the opposite side shower wall. It has two large rotating disk wheels that gently massage and clean the human body automatically, both attached to the same body unit. A container of soapy water directs the soapy water to flow onto the two disk wheels continuously through the shower. The disk wheels spin in opposite directions at exactly the same speed, controlled by a single motor and a round rubber belt that connects two shafts. The lower disk wheel also moves backwards and forwards to maintain continuous contact with the contours of the user's body. It is braced against the back wall of the shower enclosure and kept in position by adjustable arms. The unit is intended to be repositioned to clean the human body from shoulders to feet. This is accomplished by raising and lowering the unit through a set of pulleys and a pulley cord. Its speed and efficiency make it ideal for conserving time, water, and energy. In addition to massaging the body, it cleans thoroughly and is especially useful for anyone with limited hand or arm mobility.

Figure 1:
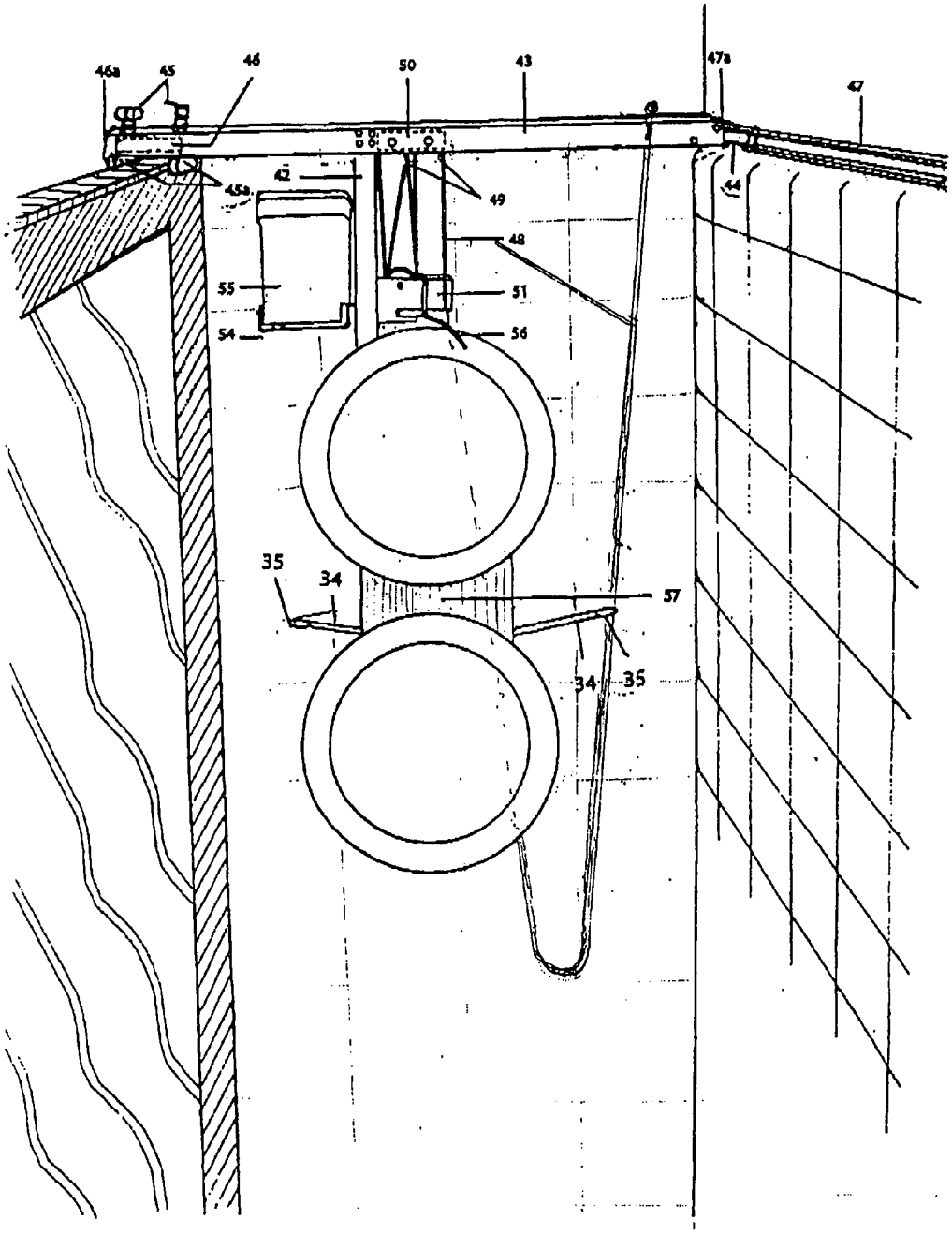

The Electric Shower Masseuse is generally shown as 57 (FIG. 1). The device consists of upper interior components (FIG. 2A), lower interior components (FIG. 2B)), and a back-to-wall support (FIG. 3A), all attached to a body 18 and hung from a T-shaped suspension system (FIG. 3B).

Upper Interior Components (FIG. 2A)

The upper interior components are operated by a switch 12 and a motor 10, which can be powered by batteries 13 or an AC/DC transformer connected to ordinary household current. The motor 10 and the motor shaft 4 are supported by mounting blocks 11, 9, and 6. The motor shaft 4 also drives a disk wheel assembly, consisting of a rigid back support 3, flexible padding 2 that creates a convex shape, and a waterproof cover 1. The disk wheel assembly is sealed so that water and bacteria cannot affect the padding. A pulley 7, with circular bearings 5 on each side, is also connected to the motor shaft 4, and propels a belt 8, which connects to the lower interior components. The pulley 7 has unique design features that support its function in ensuring that the belt stays within the track of the pulley even as it moves forward and backward with the lower motor shaft 22. The belt 8 is assembled in a figure-8 position to enable it to rotate the upper and lower disk wheel assemblies in opposite directions.

A separator (14, 15, 16, 17) is mounted between the upper and lower interior components at the point where the belt 8 crosses itself. The separator (14, 15, 16, 17) can spin freely between the two sections of the belt 8 as it rolls and moves forward and backward, virtually eliminating friction.

Lower Interior Components (FIG. 2B)

The lower interior components support two purposes: to rotate the lower disk wheel and to enable the lower disk wheel to move forward and backward while it is spinning. The disk wheel assembly, consisting of a rigid back support 21, flexible padding 20, and a waterproof cover 19, is rotated by a motor shaft 22, which is operated by the same motor 10 via the belt 8 and lower pulley 25. The disk wheel assembly is sealed so that water and bacteria cannot affect the padding. Two mounting blocks 23 and 27 attach the lower interior components to the body 18. A third mounting block 26 is secured to one end of the motor shaft 22. Four circular bearings 24 are located on either side of mounting blocks 23 and 26.

The mechanism that allows the lower disk wheel assembly to move forward and backward consists of two sets of rails and tubes (28, 29, and 30) that compress and expand to allow the movement when the user applies pressure to the disk wheel. Springs 31, secured by screws 32, push the lower disk wheel assembly back to its original position after the pressure from the user has been released.

Back-to-Wall-Support (FIG. 3A)

A T-shaped rail 33 attaches to the body 18. It includes a hole to secure the arms 34 as well as an open channel that is used to set the unit at the desired distance from the wall. The end of the T-shaped rail 33 is rubber to cushion the back-to-wall support against the shower wall.

Each of the two arms 34 has a hole drilled at one end as well as slots drilled through the Arm near that end. The ends 35 are covered with rubber to protect the shower wall. Braces 36 attach to the arms 34 and the T-shaped rail 33 and are used to open and close the arms 34, thereby regulating the distance from the shower wall. A knob 37 controls the action of the braces 36. The screw portion of the knob 37 passes through the open channel of the T-shaped rail 33 and is secured in any desired position by a square ring 38 and a flat square 39. A spring 40 allows the arms 34 to close when the knob 37 is released.

T-Shaped Hanging System (FIG. 3B)

The T-shaped hanging system consists of a horizontal and a vertical component. The horizontal component is based on a hanging bar 43. It contains the upper part of the pulley mechanism 50 for raising and lowering the unit. At one end, a holding bar 44 connects to a block 47*a* and slides into a wall-mounted rail 47 to stabilize the bar 43; at the other end, two holding knobs 45 secure the bar to the shower door frame.

The inner knob 45 is also connected to one end of a powerful spring 46. The other end of the spring connects to a block 46*a* at the outer end of the bar 43 and pulls the end of the bar 43 toward the wall-mounted rail 47. The outer knob 45 is stationary to hold the horizontal bar 43 in place. Once the bar 43 is in place, the knobs 45 are tightened to keep it from moving sideways, while still allowing it to move freely back and forth along the top of the sliding door frame. At the base of the knobs 45, blocks 45*a* secure the bar 43 to the shower door frame.

The vertical component of the hanging system includes an inner slider 41 that attaches to the body 18. Surrounding the inner slider 41 is an outer slider 42, which is connected to the horizontal bar 43. A small collar 42*a* ensures that the inner slider 41 and the outer slider 42 remain connected.

Pulley cords 48 are used to raise and lower the unit so that it reaches the entire body. Multiple pulleys 49 are used to distribute the weight. The upper pulleys 49 are connected to the horizontal bar 43, and the lower pulleys 49 fit into a holder 51, which is mounted on the outer slider 42 with a flat panel 53.

The holder 51 serves several purposes. In addition to supporting the lower pulleys 49, it also provides a notch at the end to secure the pulley cords 48. The holder 51 also connects to the water reservoir base 54 and the water reservoir 55. It provides support for the water delivery tube 56, which is secured upright when it is not being used, and rotates to a horizontal position to dispense soapy water. The end of the tube is rubber, which moves freely when in contact with the body to touch the skin gently. As an alternative to the gravity-activated method of dispensing the water, the water reservoir can be operated automatically with a motor and switch.

Prior art lacks many of these features, for example:

1. A search of patents found no other invention that suspended the device from the shower door frame. The spring mechanism for holding the horizontal bar firmly against the opposite wall is also not in prior art.

2. In addition, although other inventions presented rotating disks, none included a means for setting up one motor to rotate two disk wheels in opposite directions at exactly the same speed.

3. No invention cited includes a mechanism that allows for the lower disk wheel to be moved forward and backward while it is spinning to conform to the contours of the body. This invention uses a system of sliding tubes that compress to move the lower disk wheel forward, and springs to return it to its original position.

4. The design of the belt and pulleys relies on a round belt being configured in a figure-8 shape. The fact that the two sections of the belt cross each other required the invention of a separator to remove the friction. No other invention found mentioned a separator guide.

5. Because one of the intentions of this device is conservation of water, time, and energy, it was expressly designed with two disk wheels (to cover more surface area), a high rate of speed, and a mechanism for raising and lowering the unit efficiently so that the entire body can be cleaned and massaged in a very short period of time.

6. The means for bracing the unit against the back of the shower wall is not represented in other inventions searched. The arms are controlled by a single knob; loosening the knob causes the arms to spring together, while pressure against the arms will push them open toward the wall. The knob is threaded through an open channel on a rail at the back of the unit. It is secured along the back support rail because the screw in the knob is connected to a flat square with sharp teeth that tighten against the rail and allow the connection to hold at any point.

The invention claimed is:

1. An electric shower masseuse machine that is mounted in an existing shower enclosure and cleans and massages people's bodies in a very short time, said machine comprising:

a. A housing unit that contains a gear motor operated by rechargeable batteries, which rotates an upper shaft inside an upper pulley in a counter-clockwise direction while connecting to a lower pulley by a round rubber belt in a figure 8 configuration, thereby driving a lower shaft which is inside a lower pulley that is connected to a block that is attached to the base of said housing unit, thereby allowing said shafts to rotate in opposite directions, with said lower shaft also using two sets of rods inside tubes that compress and slide inside each other to allow said lower shaft to move backwards and forwards while it is rotating and be pulled to its original position with a spring, with said figure 8 configuration of said round rubber belt requiring a separator to be fastened to said housing unit in such a way that said separator is positioned at the exact level at which said round rubber belt crosses itself in said figure 8 configuration, with said separator consisting of four parts: (1) a nail which is placed inside (2) a freely rotating hollow metal tube, (3) the pierced tip of said nail which is secured by a pin to (4) a rubber block that is mounted to the wall of said housing unit and holds said separator in a position perpendicular to the inside wall of said housing unit, thereby allowing said separator to move freely from left to right to follow within the motion of said round rubber belt and the motion of said lower shaft;

b. Two rotating rubber disk wheels that are connected, one to said upper shaft and one to said lower shaft on the outside of said housing unit of said machine to clean and massage people's bodies while rotating in opposite directions for stability, in which said lower shaft allows said lower rubber disk wheel to move freely backwards and forwards while it is rotating to continuously touch the contours of the user's body, with each of said rubber disk wheels being designed in three parts: a rigid back support, flexible foam padding that creates a convex shape, and a waterproof rubber cover;

c. A mounting apparatus consisting of a hollow horizontal hanging bar connected to one outer and one inner hollow vertical holding bar that slide, one inside the other, to raise and lower said machine using a pulley cord connected to a set of upper and lower pulleys in series that are attached to said inner vertical hollow holding bar to distribute the weight of said machine for lifting and lowering, and an H-shaped notch around which to wrap said pulley cord to position said machine at any desired height, said notch being located at the end of a multi-function holder which is mounted to said inner vertical hollow holding bar; and said hollow horizontal hanging bar being anchored securely between the top of an existing shower door frame and its opposite wall by installing on said opposite wall a horizontal hollow rail that includes a track into which slides one end of said hollow horizontal hanging bar, with the other end of said hollow horizontal hanging bar being mounted to the existing shower door frame by two control knobs, so as that the outer control knob is positioned on the outside of the top of the existing shower door frame and the inner control knob is positioned on the inside of the top of the existing shower door frame, with a strong hidden spring connecting said inner control knob to the nearer end of said hollow horizontal hanging bar, with said strong hidden spring serving two functions: to pull said end of said hollow horizontal hanging bar toward said opposite wall of the existing shower enclosure and to hold said inner control knob tightly toward the top of the existing shower door frame, thereby allowing said machine to be securely mounted in the existing shower enclosure while allowing the user to slide said machine closer or farther from the existing shower head;

d. A back support system to position said machine securely against the back wall of the shower enclosure, consisting of a T-shaped plastic rail, whereby the top of said T-shaped plastic rail is connected to the back of the body of the said machine and whose lower part includes an open channel in the middle large enough to allow a screw to move freely along the channel; and two arms which are also attached to the top of said T-shaped plastic rail, and whose opening and closing are controlled by said screw located at the top of said channel and a hollow square ring surrounding the said channel and that contains a square plate with sharp teeth at the upper surface inside the bottom of said square ring, as follows: once the desired position of said arms is achieved, said screw is tightened, pulling said sharp surface teeth of said plate to tighten toward said T-shaped plastic rail, causing the said sharp surface teeth of said internal plate to grip said channel of said T-shaped plastic rail firmly at any distance from the shower enclosure wall; and e. A soapy water delivery system that provides a continuous supply of clean soapy water to wet the body of the user, by which the user places soapy water in a water container which is attached to said multi-function holder, and a soapy water dispensing tube is connected to said water container in such a way that it can be raised or lowered to allow said soapy water flow to wet the body of the user via gravity, the rate of flow of said soapy water also being controlled by pushing said soapy water dispensing tube up or down, and on which said soapy water dispensing tube also is equipped with a soft rubber extension tip to ensure gentleness when it touches the body of the user.

2. A back-to-wall support system for said electric shower masseuse machine according to claim 1 wherein the back-to-wall support system regulates the distance between the body of said machine and the back wall of an existing shower enclosure and which is assembled as follows:

a. The T-shaped T-shaped plastic rail is fastened to the back of the body of said machine, whose lower part includes an open channel;

b. The T-shaped control screw moves freely within a channel on the back support rail to allow great flexibility in setting the distance. Two metal arms are also fastened to the top of said T-shaped plastic rail and are connected to each other by a spring;

c. Two metal braces connect the arms to a T-shaped control screw;

d. A hollow square ring surrounds said channel;

e. Said T-shaped control screw is inserted through a hole in the top of said hollow square ring, then through said open channel in said T-shaped plastic rail, then through a square plate that is positioned inside the bottom of said square ring and that has sharp surface teeth facing toward the bottom of the T-shaped plastic rail, and then through a hole at the bottom of said hollow square ring;

f. As said T-shaped screw is moved to the desired location along the open channel of said T-shaped plastic rail, thereby setting the desired position of said metal arms, said screw is tightened, pulling said sharp surface teeth of said plate to tighten toward said T-shaped plastic rail, causing the said sharp surface teeth of said square plate to grip said channel of said T-shaped plastic rail firmly at any position.

3. A system according to claim 1 wherein one said single motor is used to power said two shafts in opposite directions at exactly the same revolutions per minute through the use of said round rubber belt used in a figure 8 configuration with said separator installed where said round rubber belt crosses itself to minimize wear on said round rubber belt:

a. Said motor is connected to said upper shaft, which is connected to said upper rubber disk wheels, said upper pulley being located between said motor and said rubber disk wheel and also rotated by the said upper shaft;

b. Said upper pulley, which is connected to said lower pulley at the bottom of said housing unit by said round rubber belt;

c. Said lower pulley is connected to said lower shaft, which rotates said lower rubber disk wheel at the exact same speed as said upper rubber disk wheel but in the opposite direction;

d. Said round rubber belt is configured in the shape of a figure eight, rotating said upper shaft clockwise and said lower shaft counter-clockwise, thereby providing balance and stability to said electric shower masseuse machine when said rubber disk wheels are spinning;

e. Said separator is positioned where said round rubber belt crosses itself to form a figure eight, between the two parts of said round rubber belt to minimize friction on the said round rubber belt;

f. Because said lower disk wheel can be pushed backwards and forwards by the user of said electric shower masseuse machine, said lower pulley at the base of said housing unit also moves backwards and forwards together with said lower rubber disk wheel, requiring that said round rubber belt be round so that it can roll with the movement of said lower pulley and stay inside said lower pulley;

g. The walls of said upper pulley and said lower pulley are high enough to prevent said round rubber belt from slipping out of said upper and lower pulleys;

h. The inner core of said upper pulley and said lower pulley is flat and embedded with inverted U-shaped notches that grip said round rubber belt and also keep it from slipping.

4. A device according to claim 1 that forms a separator guide for the round rubber belt, as follows:

a. A nail is modified such that a hole is drilled through the flattened sharp end of said nail and said nail is placed inside of a hollow metal tube;

b. Said nail inside of said hollow metal tube is inserted into a circular opening in a rubber mount;

c. A pin goes through said rubber mount from top to bottom and goes through said hole in said nail so that the said nail and said metal tube move freely from left to right within said circular opening in said rubber mount;

d. Said assembled separator is mounted to the wall of said housing unit and holds said separator in a position perpendicular to the inside wall of said housing unit;

e. Said nail and said hollow metal tube moves freely from left to right held by said pin within said rubber mount;

f. Said assembled separator is positioned between the two sections of said round rubber belt where said sections cross in their figure 8 configuration;

g. When said round rubber belt touches said separator, the said two sections of said round rubber belt are moving in opposite directions causing said hollow metal tube to spin around said nail; and h. Said separator moves freely from left to right to follow the motion of said round rubber belt and the motion of said lower shaft as it is pushed backwards and forwards while it is rotating.

5. A system according to claim 1 that allows said lower disk wheel to move forward and backward, as follows:

a. Three support blocks form the structure of the system, wherein:

b. Two rods are fixed at said first and third blocks; each of said rods is positioned inside a tube, which slides into a larger tube; the said two larger tubes are fixed to said second block, allowing said lower shaft and said second block to move forward and backward with said lower disk wheel; and c. Two springs connect said first block to said second block and return the four connected items (said lower disk wheel, said lower shaft, said lower pulley, and said second block together) to their original positions after said lower disk wheel is pushed backward.

6. A safety spring mechanism according to claim 1, wherein said horizontal hanging bar of said mounting apparatus is pushed securely toward the opposite wall of an existing shower enclosure, as follows:

a. A hidden spring is connected between the outer edge of said hollow horizontal hanging bar and said inner control knob within the hollow part of said hollow horizontal hanging bar;

b. Said hollow horizontal hanging bar is mounted on top of the frame of the sliding door of an existing shower enclosure, with said outer control knob on the outside of said sliding door frame and said inner control knob on the inside of said sliding door frame;

c. When the unit is in position, said inner and outer control knobs are tightened and the spring is held in a stretched position to push and hold said hollow horizontal hanging bar firmly against the wall of said existing shower enclosure that is opposite from said existing shower door frame.

7. A multi-function holder block according to claim 1, which serves two purposes: To raise and lower said electric shower masseuse to the desired height and to hold and dispense soapy water to wet the user's body, as follows:

a. The multi-function holder is connected to said inner hollow vertical holding bar;

b. Said multi-function holder contains a pulley system for raising and lowering said electric shower masseuse by using five pulleys and a pulley cord, thereby dividing the weight of said electric shower masseuse among said five pulleys (two in said multi-function holder and three inside said hollow horizontal hanging bar);

c. Said multi-function holder includes an H-shaped notch that holds said pulley cord at the desired height by wrapping said pulley cord around said H-shaped notch:

d. Said multi-function holder is connected to the water tank holder, which holds the soapy water container;

e. Said multi-function holder includes an opening through which the soapy water dispensing tube is connected to said water container in such a way that it can be raised or lowered to allow said soapy water flow to wet the body of the user via gravity, the rate of flow of said soapy water also being controlled by pushing said soapy water dispensing tube up or down, and said soapy water dispensing tube also is equipped with a soft rubber extension tip to ensure gentleness when it touches the body of the user.

* * * * *